US010345738B2

(12) United States Patent
Yamaguchi

(10) Patent No.: US 10,345,738 B2
(45) Date of Patent: Jul. 9, 2019

(54) STIRRING/CONVEYING MEMBER, AND DEVELOPING DEVICE AND IMAGE FORMING APPARATUS THEREWITH

(71) Applicant: KYOCERA Document Solutions Inc., Osaka (JP)

(72) Inventor: Akifumi Yamaguchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/713,085

(22) Filed: Sep. 22, 2017

(65) Prior Publication Data

US 2018/0129149 A1 May 10, 2018

(30) Foreign Application Priority Data

Nov. 9, 2016 (JP) ..... 2016-219067

(51) Int. Cl.
*G03G 15/08* (2006.01)

(52) U.S. Cl.
CPC ..... *G03G 15/0889* (2013.01); *G03G 15/0812* (2013.01); *G03G 15/0887* (2013.01); *G03G 15/0891* (2013.01); *G03G 15/0893* (2013.01); *G03G 2215/0802* (2013.01); *G03G 2215/083* (2013.01); *G03G 2215/0816* (2013.01); *G03G 2215/0819* (2013.01); *G03G 2215/0833* (2013.01)

(58) Field of Classification Search
CPC ..... G03G 15/0889; G03G 15/0812; G03G 15/0887; G03G 15/0891; G03G 15/0893; G03G 2215/083; G03G 2215/0833; G03G 2215/0802; G03G 2215/0816; G03G 2215/0819; G03G 2215/0827
See application file for complete search history.

(56) References Cited

U.S. PATENT DOCUMENTS

2008/0025763 A1 1/2008 Suenami ..... 399/256
2011/0069993 A1* 3/2011 Yamamuro ..... G03G 15/0893 399/254
2012/0201573 A1 8/2012 Watanabe et al. ..... 399/256

FOREIGN PATENT DOCUMENTS

JP 2008-33109 A 2/2008
JP 2012-163731 A 8/2012

* cited by examiner

*Primary Examiner* — Joseph S Wong
(74) *Attorney, Agent, or Firm* — Stein IP, LLC

(57) ABSTRACT

A stirring/conveying member has a rotary shaft rotatably supported in a powder container, a first helical blade formed on the circumferential surface of the rotary shaft and conveying powder in the axial direction by the rotation of the rotary shaft, and a second helical blade formed on the circumferential surface of the rotary shaft to overlap the forming region of the first helical blade, spiraling in the opposite phase to the first helical blade, and having a smaller radial height than the first helical blade. The first helical blade crosses the second helical blade at least at one place in one turn about the rotary shaft. At least one of the radial heights of the first and second helical blades equals zero at the intersection of the first and second helical blades.

8 Claims, 7 Drawing Sheets

STIRRING/CONVEYING MEMBER, AND DEVELOPING DEVICE AND IMAGE FORMING APPARATUS THEREWITH

INCORPORATION BY REFERENCE

This application is based upon and claims the benefit of priority from the corresponding Japanese Patent Application No. 2016-219067 filed on Nov. 9, 2016, the entire contents of which are incorporated herein by reference.

BACKGROUND

The present disclosure relates to a stirring/conveying member that conveys, while stirring, powder such as developer, to a developing device provided with such a stirring/conveying member, and to an image forming apparatus incorporating such a developing device.

In image forming apparatuses, a latent image formed on an image carrying member comprising a photosensitive member or the like is made visible by being developed into a toner image by a developing device. Some such developing devices adopt a two-component developing system that uses two-component developer. In this type of developing device, developer containing carrier and toner is stored in a developer container, there is arranged a developing roller which feeds the developer to the image carrying member, and there is arranged a stirring/conveying member which conveys, while stirring, the developer inside the developer container to feed it to the developing roller.

In the two-component developing system, insufficient electrostatic charging of toner may lead to image defects such as splashed toner and a foggy image. Thus, it is necessary to sufficiently stir and mix toner and carrier together to electrostatically charge the toner to a predetermined charging amount.

As a solution, a powder stirring/conveying member is known which includes a shaft member, a main conveying blade which conveys powder in a first direction toward one side of the axial direction as the shaft member rotates, and a sub-conveying means which exerts on part of the powder a conveying action in a second direction toward the other side of the axial direction as the shaft member rotates. As the sub-conveying means, a sub-conveying blade is known which has a smaller diameter than the main conveying blade and which spirals in the opposite direction (opposite phase) to the main conveying blade.

A stirring/conveying member is known which includes a rotary shaft, a first helical blade which is formed on the circumferential surface of the rotary shaft and which conveys powder in the axial direction by the rotation of the rotary shaft, and a second helical blade which is formed on the circumferential surface of the rotary shaft to overlap the forming region of the first helical blade, spirals in the opposite phase to the first helical blade, and has a smaller radial diameter than the first helical blade. In this stirring/conveying member, the first helical blade and the second helical blade have a trapezoidal sectional shape on a plane traversing the helical blades in their longitudinal direction. In the first helical blade and the second helical blade, there are respectively formed a plurality of first expansion portions and second expansion portions where the base part of the trapezoid expands wider than elsewhere in one turn about the rotary shaft. The first and second helical blades cross each other at least at one place at the first expansion portion in one turn about the rotary shaft.

With the above configurations, the second helical blade (sub-conveying blade) exerts a conveying force in the direction opposite to the developer conveyance direction of the first helical blade (main conveying blade), and thus convection occurs on part of the conveyed developer; this promotes the stirring effect with almost no interference with the conveying action of the first helical blade (main conveying blade). As a result, the stirring/conveying member can, while retaining both the conveying force of powder such as developer and the stirring effect, avoid applying excessive stress to the powder and is excellent in moldability.

SUMMARY

According to one aspect of the present disclosure, a stirring/conveying member includes a rotary shaft, a first helical blade, and a second helical blade. The rotary shaft is rotatably supported in a powder container. The first helical blade is formed on the circumferential surface of the rotary shaft, and conveys powder in the axial direction by the rotation of the rotary shaft. The second helical blade is formed on the circumferential surface of the rotary shaft to overlap the forming region of the first helical blade, spirals in the opposite phase to the first helical blade, and has a radial height smaller than that of the first helical blade. The first helical blade and the second helical blade have a trapezoidal sectional shape on a plane traversing the helical blades in their longitudinal direction. The first helical blade crosses the second helical blade at least at one place in one turn about the rotary shaft. At least one of the radial heights of the first helical blade and the second helical blade equals zero at the intersection of the first helical blade and the second helical blade.

Further features and advantages of the present disclosure will become apparent from the description of embodiments given below.

DETAILED DESCRIPTION

Figure 1:
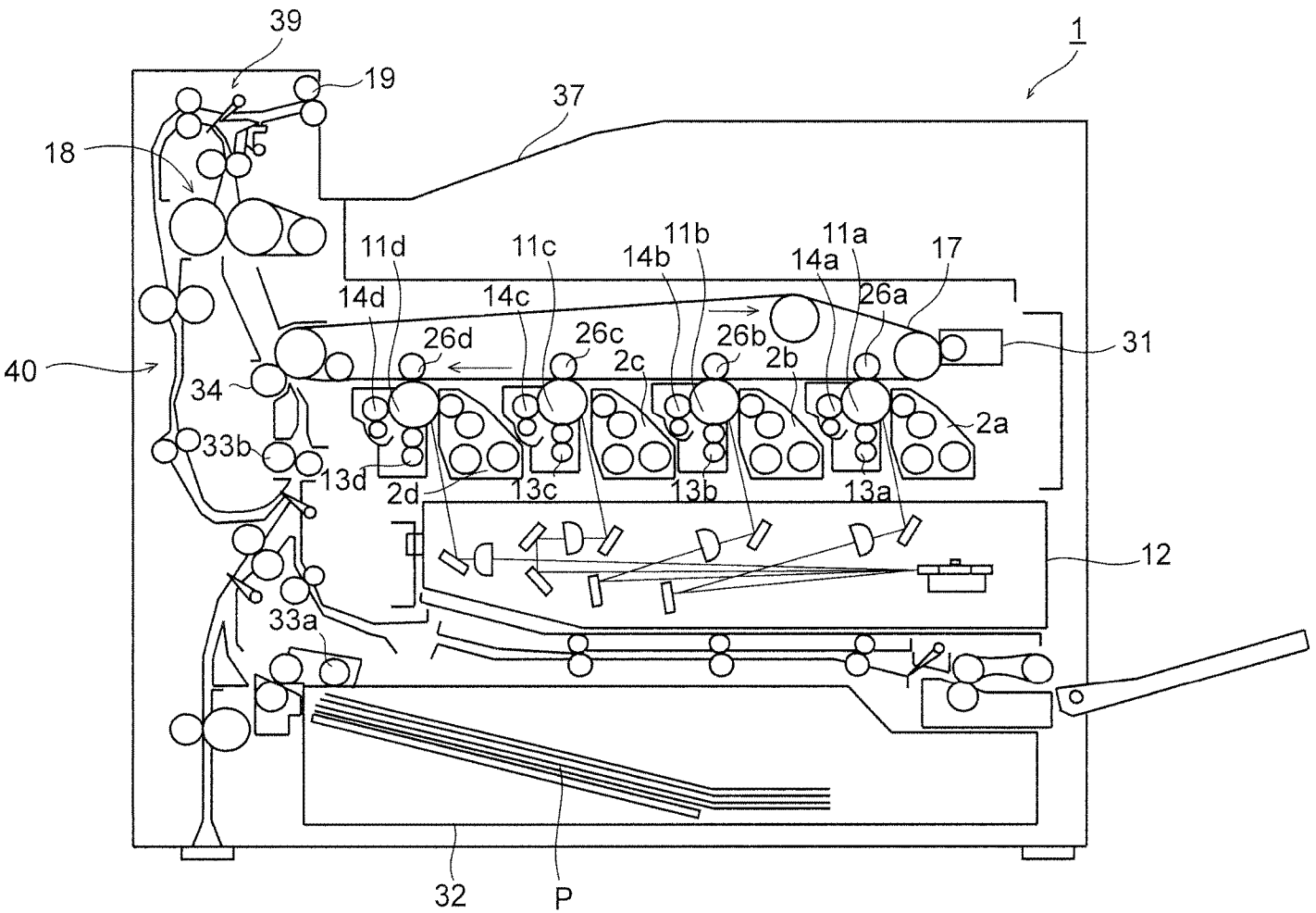
FIG. 1 is a schematic diagram showing an overall construction of an image forming apparatus incorporating a developing device according to the present disclosure.

Hereinafter, embodiments of the present disclosure will be described with reference to the accompanying drawings. FIG. 1 is a schematic sectional view of an image forming apparatus 1 incorporating developing devices 2*a* to 2*d* according to the present disclosure, here showing a tandem-type color printer. In the image forming apparatus 1, there are respectively arranged photosensitive drums 11*a*, 11*b*, 11*c*, and 11*d* that carry visible images (toner images) of different colors, and these sequentially form cyan, magenta, yellow, and black images respectively, each through the processes of electrostatic charging, exposure to light, image development, and image transfer. Moreover, an intermediate transfer belt 17 that rotates in the clockwise direction in FIG. 1 is arranged next to the photosensitive drums 11*a* to 11*d*.

When image data is fed in from a host device such as a personal computer, first, by charging devices 13*a* to 13*d*, the surfaces of the photosensitive drums 11*a* to 11*d* are electrostatically charged uniformly. Then, through irradiation by an exposing device 12 with light based on the image data, electrostatic latent images based on the image data are formed on the photosensitive drums 11*a* to 11*d* respectively. The developing devices 2*a* to 2*d* are charged with predetermined amounts of two-component developer (hereinafter, also referred to simply as developer) containing toner of different colors, namely cyan, magenta, yellow, and black respectively, from toner containers (unillustrated). The toner contained in the developer is fed from the developing devices 2*a* to 2*d* to the photosensitive drums 11*a* to 11*d*, and electrostatically attaches to them. Thereby, toner images are formed based on the electrostatic latent images formed by exposure to light from the exposing device 12.

Then, an electric field is applied, by primary transfer rollers 26*a* to 26*d*, between the primary transfer rollers 26*a* to 26*d* and the photosensitive drums 11*a* to 11*d* with a predetermined transfer voltage. Thereby, the cyan, magenta, yellow, and black toner images on the photosensitive drums 11*a* to 11*d* are primarily transferred to the intermediate transfer belt 17. Toner and the like that remain on the surfaces of the photosensitive drums 11*a* to 11*d* after primary transfer are removed by cleaning devices 14*a* to 14*d*.

Transfer sheets P to which toner images are to be transferred are stored in a sheet cassette 32 arranged in a lower part inside the image forming apparatus 1. A transfer sheet P is conveyed, via a sheet feeding roller 33*a* and a registration roller pair 33*b*, with predetermined timing, to a nip (secondary transfer nip) between a secondary transfer roller 34, which is arranged next to the intermediate transfer belt 17, and the intermediate transfer belt 17. The transfer sheet P having the toner images secondarily transferred to it is conveyed to a fixing portion 18. Toner and the like that remain on the surface of the intermediate transfer belt 17 after secondary transfer are removed by a belt cleaning device 31.

The transfer sheet P conveyed to the fixing portion 18 is then heated and pressed there so that the toner images are fixed to the surface of the transfer sheet P to form a predetermined full-color image. The transfer sheet P having the full-color image formed on it is discharged as it is (or after being distributed by a branching portion 39 into a reverse conveyance passage 40 and having images formed on both sides of it) onto a discharge tray 37 via a discharge roller pair 19.

Figure 2:
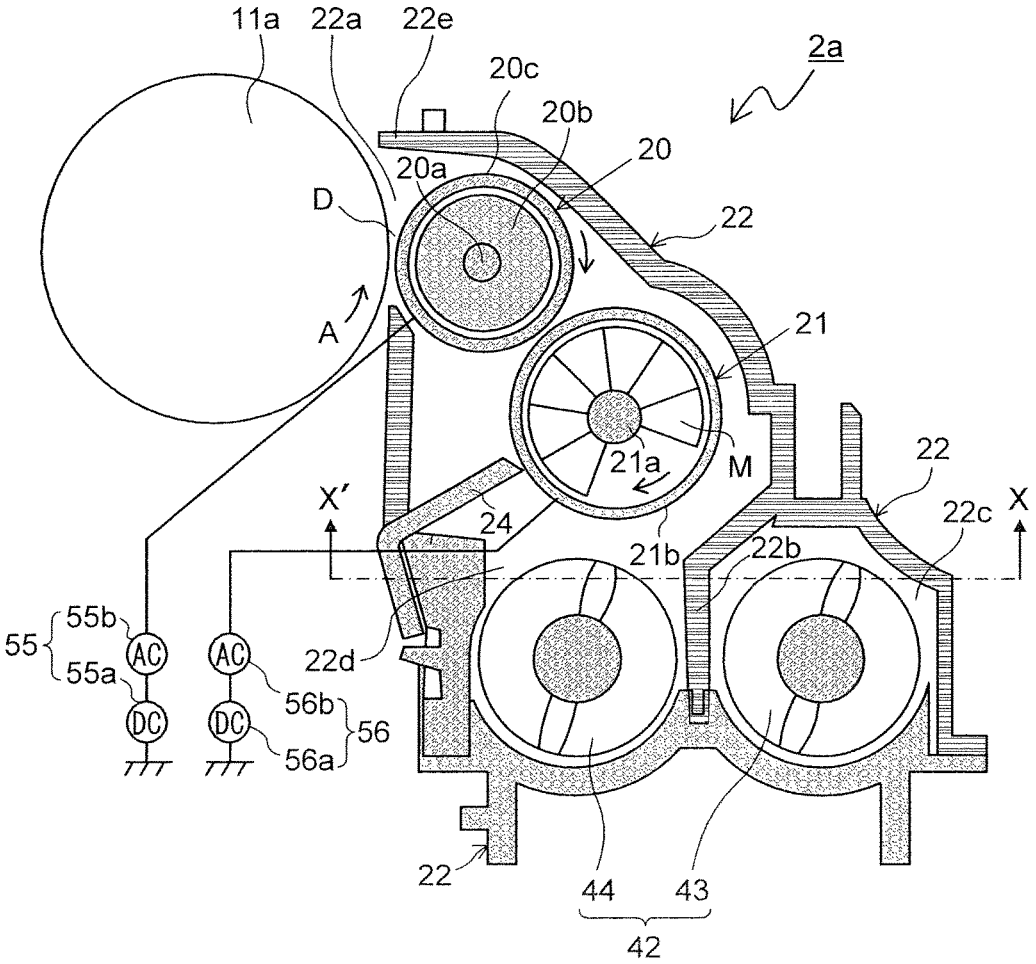
FIG. 2 is a side sectional view of the developing device incorporating first and second spirals constituting a stirring/conveying member according to the present disclosure.

FIG. 2 is a side sectional view showing the structure of the developing device 2*a* according to the present disclosure. Although the following description deals with the structure and operation of the developing device 2*a* corresponding to the photosensitive drum 11*a* shown in FIG. 1, the structure and operation of the developing devices 2*b* to 2*d* are similar to those of the developing device 2*a*, and thus no overlapping description will be repeated.

As shown in FIG. 2, the developing device 2*a* includes a developing roller 20, a magnetic roller 21, a regulating blade 24, a stirring/conveying member 42, a developer container 22, and the like.

The developer container 22 forms the housing of the developing device 2*a*, and is divided, in a lower part of it, into a first conveyance chamber 22*c* and a second conveyance chamber 22*d* by a partition 22*b*. In the first conveyance chamber 22*c* and the second conveyance chamber 22*d*, developer containing carrier and toner is stored. The developer container 22 rotatably holds the stirring/conveying member 42, the magnetic roller 21, and the developing roller 20. In the developer container 22, there is formed an opening 22*a* through which the developing roller 20 is exposed toward the photosensitive drum 11*a*.

The developing roller 20 is arranged opposite the photosensitive drum 11*a* across a predetermined distance, on the right side of the photosensitive drum 11*a*. The developing roller 20 forms, at a position opposite and close to the photosensitive drum 11*a*, a developing region D where toner is fed to the photosensitive drum 11*a*. The magnetic roller 21 is arranged opposite the developing roller 20 across a predetermined distance, obliquely on the lower right side of the developing roller 20. The magnetic roller 21 feeds, at a position opposite and close to the developing roller 20, toner to the developing roller 20. The stirring/conveying member 42 is arranged substantially under the magnetic roller 21. The regulating blade 24 is fixedly held on the developer container 22, obliquely on the lower left side of the magnetic roller 21.

The stirring/conveying member 42 is composed of two spirals, namely a first spiral 43 and a second spiral 44. The second spiral 44 is arranged under the magnetic roller 21, in the second conveyance chamber 22*d*. The first spiral 43 is arranged next to the second spiral 44, on the right side of it, in the first conveyance chamber 22*c*.

The first and second spirals 43 and 44, while stirring developer, electrostatically charge the toner contained in the developer up to a predetermined level. This allows the toner to be held on the carrier. Communication portions (unillustrated) are provided in opposite longitudinal-direction (the front/rear direction with respect to the plane of FIG. 2) end parts of the partition 22*b* which separates the first conveyance chamber 22*c* and the second conveyance chamber 22*d*. As the first spiral 43 rotates, the charged developer is conveyed to the second spiral 44 via one of the communication portions provided in the partition 22*b*, so that the developer circulates through the first conveyance chamber 22*c* and the second conveyance chamber 22*d*. Then, the developer is fed from the second spiral 44 to the magnetic roller 21.

The magnetic roller 21 is composed of a roller shaft 21*a*, a magnetic pole member M, and a non-magnetic sleeve 21*b* formed of a non-magnetic material. The magnetic roller 21 carries on it the developer fed from the stirring/conveying member 42, and feeds, out of the developer, the toner alone to the developing roller 20. The magnetic pole member M has a plurality of magnets, which are each formed to have a fan-shaped section and which have on their peripheral parts different magnetic polarities from one to the next, arranged alternately. The magnetic pole member M is fixed to the roller shaft 21*a* with adhesive or otherwise. The roller shaft 21*a* is non-rotatably supported on the developer container 22 in the non-magnetic sleeve 21*b*, with a predetermined distance between the magnetic pole member M and the non-magnetic sleeve 21*b*. The non-magnetic sleeve 21*b* rotates in the same direction (the clockwise direction in FIG. 2) as the developing roller 20 by the action of a driving mechanism comprising a motor and gears, of which none is illustrated. To the non-magnetic sleeve 21*b*, a bias 56 having an AC voltage 56*b* superimposed on a DC voltage 56*a* is applied. On the surface of the non-magnetic sleeve 21*b*, the charged developer is carried in the form of a magnetic brush by the magnetic force of the magnetic pole member M, and the magnetic brush is adjusted to have a predetermined height by the regulating blade 24.

As the non-magnetic sleeve 21*b* rotates, the magnetic brush is conveyed while being carried on the surface of the non-magnetic sleeve 21*b* by the magnetic pole member M. When the magnetic brush makes contact with the developing roller 20, the toner alone out of the magnetic brush is fed to the developing roller 20 according to the bias 56 applied to the non-magnetic sleeve 21*b*.

The developing roller 20 is composed of a fixed shaft 20*a*, a magnetic pole member 20*b*, a developing sleeve 20*c* formed of a non-magnetic metal material in a cylindrical shape, and the like.

The fixed shaft 20*a* is non-rotatably supported on the developer container 22. Around the fixed shaft 20*a*, the developing sleeve 20*c* is rotatably held, and to the fixed shaft 20*a*, the magnetic pole member 20*b* comprising a magnet is fixed with adhesive or otherwise at a position opposite the magnetic roller 21, at a predetermined distance from the developing sleeve 20*c*. The developing sleeve 20*c* rotates in the direction indicated by an arrow in FIG. 2 (the clockwise direction) by the action of a driving mechanism comprising a motor and gears, of which none is illustrated. To the developing sleeve 20*c*, a developing bias 55 having an AC voltage 55*b* superimposed on a DC voltage 55*a* is applied.

As the developing sleeve 20*c* to which the developing bias 55 is applied rotates in the clockwise direction in FIG. 2, in the developing region D, due to the potential difference between the developing bias and the bias of the exposed part of the photosensitive drum 11*a*, toner carried on the surface of the developing sleeve 20*c* flies to the photosensitive drum 11*a*. The flying toner attaches, sequentially, to the exposed part on the photosensitive drum 11*a* that rotates in the direction indicated by arrow A (the counter-clockwise direction), and thereby the electrostatic latent image on the photosensitive drum 11*a* is developed.

Figure 3:
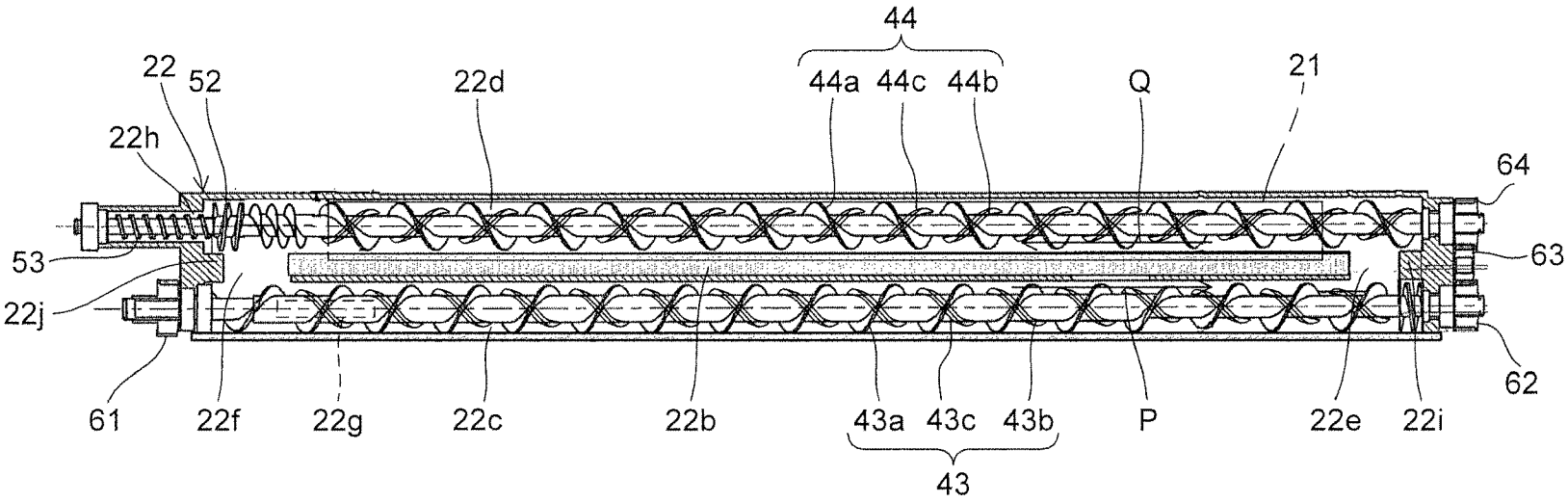
FIG. 3 is a sectional plan view of a stirring portion in the developing device according to the present disclosure.

Now, a stirring portion in the developing device 2*a* will be described in detail with reference to FIG. 3. FIG. 3 is a sectional plan view (sectional view across line X-X' in FIG. 2 as seen from the direction indicated by arrows X and X') of the stirring portion of the developing device 2*a*.

In the developer container 22 are formed, as described above, the first conveyance chamber 22*c*, the second conveyance chamber 22*d*, the partition 22*b*, the upstream-side communication portion 22*e*, and the downstream-side communication portion 22*f*. In the developer container 22, there are further formed a developer supply port 22*g*, a developer discharge port 22*h*, an upstream-side wall portion 22*i*, and a downstream-side wall portion 22*j*. With respect to the first conveyance chamber 22*c*, the left side in FIG. 3 is the upstream side, and the right side in FIG. 3 is the downstream side; with respect to the second conveyance chamber 22*d*, the right side in FIG. 3 is the upstream side, and the left side in FIG. 3 is the downstream side. Thus, the communication portions and the wall portions are distinguished between the upstream-side and downstream-side ones relative to the second conveyance chamber 22*d*.

The partition 22*b* extends in the longitudinal direction of the developer container 22 to separate the first conveyance chamber 22*c* and the second conveyance chamber 22*d* parallel to each other. On one hand, the right-side end part of the partition 22*b* in the longitudinal direction forms the upstream-side communication portion 22*e* together with the inner wall part of the upstream-side wall portion 22*i*. On the other hand, the left-side end part of the partition 22*b* in the longitudinal direction forms the downstream-side communication portion 22*f* together with the inner wall part of the downstream-side wall portion 22*j*. Developer passes, sequentially, through the first conveyance chamber 22*c*, the upstream-side communication portion 22*e*, the second conveyance chamber 22*d*, and the downstream-side communication portion 22*f* to circulate through the developer container 22.

The developer supply port 22*g* is an opening through which fresh toner and carrier are supplied from a developer supply container (unillustrated) provided over the developer container 22 into the developer container 22, and is arranged on the upstream side (the left side in FIG. 3) of the first conveyance chamber 22*c*.

The developer discharge port 22*h* is an opening through which developer that becomes surplus in the first and second conveyance chambers 22*c* and 22*d* as fresh developer is supplied is discharged, and is provided continuous with the second conveyance chamber 22*d* in the longitudinal direction on the downstream side of the second conveyance chamber 22*d*.

The first spiral 43 has a rotary shaft 43*b*, a first helical blade 43*a* formed in a helical shape with a predetermined pitch in the axial direction of the rotary shaft 43*b*, a second helical blade 43*c* spiraling in the opposite direction (opposite phase) to the first helical blade 43*a* with the same pitch as the first helical blade 43*a* in the axial direction of the rotary shaft 43*b*. The first helical blade 43*a* and the second helical blade 43*c* are provided to extend up to opposite end parts of the first conveyance chamber 22*c* in the longitudinal direction and to face the upstream-side and downstream-side communication portions 22*e* and 22*f*. The rotary shaft 43*b* is rotatably supported on the upstream-side wall portion 22*i* and the downstream-side wall portion 22*j* of the developer container 22. The first helical blade 43*a* and the second helical blade 43*c* are molded integrally with the rotary shaft 43*b* out of synthetic resin.

The second spiral 44 has a rotary shaft 44*b*, a first helical blade 44*a* in the axial direction of the rotary shaft 44*b*, and a second helical blade 44*c* spiraling in the opposite direction (opposite phase) to the first helical blade 44*a* with the same pitch as the first helical blade 44*a* in the axial direction of the rotary shaft 44*b*. The first helical blade 44*a* spirals in the opposite direction (opposite phase) to the first helical blade 43*a* with the same pitch as the first helical blade 43*a* of the first spiral 43. The first helical blade 44*a* and the second helical blade 44*c* have a length equal to or larger than that of the magnetic roller 21 in the axial direction, and are provided so as to extend up to a position facing the upstream-side communication portion 22*e*. The rotary shaft 44*b* is arranged parallel to the rotary shaft 43*b*, and is rotatably supported on the upstream-side wall portion 22*i* and the downstream-side wall portion 22*j* of the developer container 22. On the rotary shaft 44*b*, a regulating portion 52 and a discharge blade 53 are integrally arranged together with the first helical blade 44*a* and the second helical blade 44*c*. The structures of the first helical blades 43*a* and 44*a* and the second helical blades 43*c* and 44*c* will be described in detail later.

The regulating portion 52 makes it possible to block the developer conveyed to the downstream side in the second conveyance chamber 22*d* and to convey developer in excess of a predetermined amount to the developer discharge port 22*h*. The regulating portion 52 comprises a helical blade spiraling in the opposite direction (opposite phase) to the first helical blade 44*a* provided on the rotary shaft 44*b*, and is configured to have substantially the same outer diameter as, but a smaller pitch than, the first helical blade 44*a*. The regulating portion 52 forms a predetermined gap between an inner wall part of the developer container 22, such as the downstream-side wall portion 22*j*, and an outer circumferential part of the regulating portion 52. The surplus developer is discharged through the gap.

The rotary shaft 44*b* extends into the developer discharge port 22*h*. On the rotary shaft 44*b* in the developer discharge port 22*h*, the discharge blade 53 is provided. The discharge blade 53 comprises a helical blade spiraling in the same direction as the first helical blade 44*a*, but has a smaller pitch and a smaller blade circumference than those of the first helical blade 44*a*. Thus, as the rotary shaft 44*b* rotates, the discharge blade 53 also rotates so that the surplus developer conveyed into the developer discharge port 22*h* over the regulating portion 52 is conveyed to the left side in FIG. 3 to be discharged out from the developer container 22. The discharge blade 53, the regulating portion 52, the first helical blade 44*a*, and the second helical blade 44*c* are molded integrally with the rotary shaft 44*b* out of synthetic resin.

On the outer wall of the developer container 22, gears 61 to 64 are arranged. The gears 61 and 62 are fixed on the rotary shaft 43*a*, the gear 64 is fixed on the rotary shaft 44*b*, and the gear 63 is rotatably held on the developer container 22 to mesh with the gears 62 and 64.

According to the first spiral 43 structured as described above, the first helical blade 43*a* is provided on the outer surface of the rotary shaft 43*b*, and as the rotary shaft 43*b* rotates, the first helical blade 43*a*, while stirring, conveys developer in a first direction (the direction indicated by arrow P in FIG. 3). On the outer surface of the rotary shaft 43*b*, in a pitch (between one turn and the next) of the first helical blade 43*a*, the second helical blade 43*c* is provided which spirals in the opposite phase to the first helical blade 43*a* and which has a smaller diameter than that of the first helical blade 43*a*. As the rotary shaft 43*b* rotates, the second helical blade 43*c* exerts on developer a conveying action in a second direction (the direction indicated by arrow Q) which is the direction opposite to the first direction.

According to the second spiral 44 structured as described above, the first helical blade 44*a* is provided on the outer surface of the rotary shaft 44*b*, and as the rotary shaft 44*b* rotates, the first helical blade 44*a*, while stirring, conveys developer in the first direction (the direction indicated by arrow Q in FIG. 3). On the outer surface of the rotary shaft 44*b*, in a pitch (between one turn and the next) of the first helical blade 44*a*, the second helical blade 44*c* is provided which spirals in the opposite phase to the first helical blade 44*a* and which has a smaller diameter than that of the first helical blade 44*a*. As the rotary shaft 44*b* rotates, the second helical blade 44*c* exerts on developer, a conveying action in the second direction (the direction indicated by arrow P) which is the direction opposite to the first direction.

With the second helical blades 43*c* and 44*c* arranged radially inward of the outer end parts of the first helical blades 43*a* and 44*a*, the conveying action in the second direction produced by the rotation of the second helical blades 43*c* and 44*c* acts on a part of the developer present near the rotary shafts 43*b* and 44*b*. It thus does not hinder the conveying action in the first direction produced by the first helical blades 43*a* and 44*a*.

By producing, by use of the second helical blades 43*c* and 44*c*, a conveying action in the opposite direction (the second direction) to the developer conveyance direction (the first direction) of the first helical blades 43*a* and 44*a* as described above, convection of developer occurs in the pitch of the first helical blades 43*a* and 44*a*; this promotes stirring of developer in the pitch of the first helical blades 43*a* and 44*a* without hindering the powder (developer) conveying action by the first helical blades 43*a* and 44*a*. Thus, it is possible to speedily and sufficiently stir fresh toner and carrier, which are supplied via the developer supply port 22*g*, with two-component developer in the first conveyance chamber 22*c* and the second conveyance chamber 22*d*, and also to effectively prevent the conveyance speed of developer in the first conveyance chamber 22*c* and the second conveyance chamber 22*d* from reducing.

When the height (radial height R2; see FIG. 4) from the rotary shafts 43*b* and 44*b* to the tip ends of the second helical blades 43*c* and 44*c* is smaller than a quarter of the height (radial height R1; see FIG. 4) from the rotary shafts 43*b* and 44*b* to the tip ends of the first helical blades 43*a* and 44*a*, it is impossible to produce sufficient convection of developer in the pitch of the first helical blades 43*a* and 44*a*, and this reduces the effect of stirring. On the other hand, when R2 is larger than a half of R1, the conveying force in the second direction of the second helical blades 43*c* and 44*c* is too strong, and it thus inconveniently hinders the conveying action in the first direction produced by the first helical blades 43*a* and 44*a*.

Thus, the radial height R2 of the second helical blades 43*c* and 44*c* preferably is equal to or larger than a quarter of the radial height R1 of the first helical blades 43*a* and 44*a* but equal to or smaller than a half of it. This helps effectively prevent the conveying speed from reducing while producing convection of developer in the pitch of the first helical blades 43*a* and 44*a*.

Now, with reference to FIGS. 4 to 10, the structures of the first helical blade 44*a* and the second helical blade 44*c* of the second spiral 44 arranged in the second conveyance chamber 22*d* will be described in detail. The first helical blade 43*a* and the second helical blade 43*c* of the first spiral 43 arranged in the first conveyance chamber 22*c* have similar structures, and thus no overlapping description will be repeated.

Figure 4:
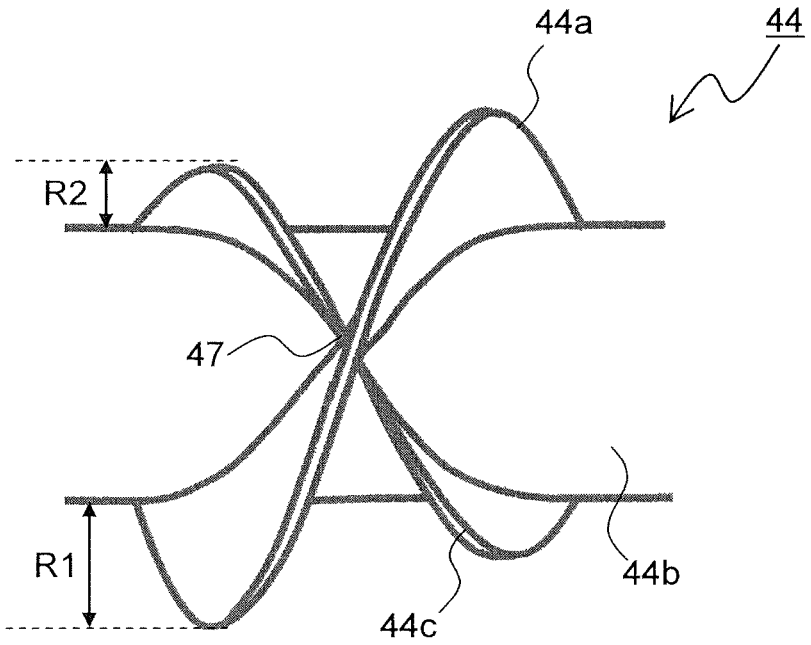
FIG. 4 is a partly enlarged view of a second spiral according to a first embodiment of the present disclosure as seen from the direction perpendicular to a rotary shaft.

FIG. 4 is a partly enlarged view of the second spiral 44 according to a first embodiment of the present disclosure as seen from the direction perpendicular to the rotary shaft 44*b*. As shown in FIG. 4, the first helical blade 44*a* and the second helical blade 44*c* constituting the second spiral 44 have a trapezoidal sectional shape on a plane traversing the helical blades in their longitudinal direction. The first helical blade 44*a* and the second helical blade 44*c* are formed to intersect at two intersections 47, at an interval of 180° from each other, in one turn of the first helical blade 44*a* and the second helical blade 44*c* about the rotary shaft 44*b*. The radial height R2 of the second helical blade 44*c* is smaller than the radial height R1 of the first helical blade 44*a*.

In this embodiment, the radial height R2 of the second helical blade 44*c* is the smaller the closer to the intersection 47 such that, at the intersection 47, R2=0. With this configuration, on the downstream side of the first helical blade 44*a* in the advance direction of its phase, the developer that stagnates in a region between the first helical blade 44*a* and the second helical blade 44*c* is more likely to disperse over the second helical blade 44*c*. On the other hand, on the upstream side of the first helical blade 44*a* in the advance direction of its phase, the developer is more likely to enter, over the second helical blade 44*c*, a region between the first helical blade 44*a* and the second helical blade 44*c* where the density of developer is low.

Thus, it is possible to suppress stagnation of developer and lowering of developer density near the intersection 47, and thereby to prevent developer from being uneven locally near the intersection 47; it is thus possible to effectively overcome image unevenness resulting from non-uniform developer being fed to the developing roller 20. The first helical blade 44*a* is formed continuously without being interrupted at the intersection 47, and thus there is no danger of a reduced conveying force of the first helical blade 44*a*.

Figure 5:
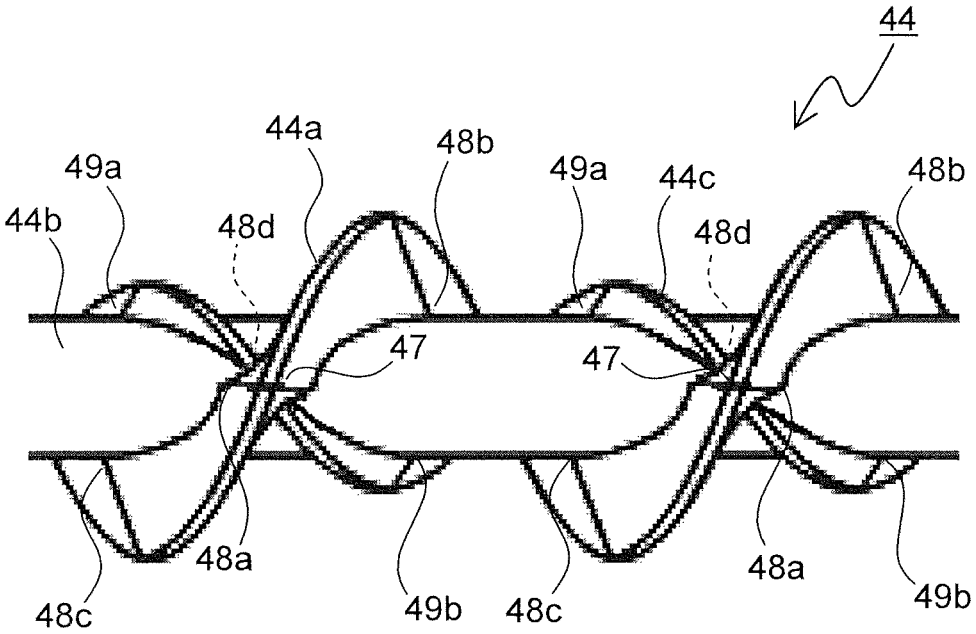
FIG. 5 is a partly enlarged view of a modified example of the second spiral according to the first embodiment where first and second expansion portions are respectively formed in first and second helical blades as seen from the direction perpendicular to a rotary shaft.

FIG. 5 is a partly enlarged view of a modified example of the second spiral 44 according to the first embodiment as seen from the direction perpendicular to the rotary shaft 44*b*. In the modified example shown in FIG. 5, in the first helical blade 44*a*, in one turn (pitch) about the rotary shaft 44*b*, portions (hereinafter, referred to as first expansion portions) 48*a* to 48*d* where the base part of the trapezoid expands wider than elsewhere are formed at four places at an interval of 90° from each other. Likewise, in the second helical blade 44*c*, in one turn (pitch) about the rotary shaft 44*b*, portions (hereinafter, referred to as second expansion portions) 49*a* and 49*b* where the base part of the trapezoid expands wider than elsewhere are formed at two places at an interval of 180° from each other. The first helical blade 44*a* crosses the second helical blade 44*c* at two places, specifically at two of the first expansion portions 48*a* and 48*d* at an interval of 180° from each other in one turn about the rotary shaft 44*b*.

By forming the first expansion portions 48*a* to 48*d* and the second expansion portions 49*a* and 49*b*, it is possible to increase the effect of reinforcing the first helical blade 44*a* and the second helical blade 44*c*, and thus to improve the performance of stirring/conveying developer. As compared with the configuration in which the base parts of the entire first helical blade 44*a* and second helical blade 44*c* are expanded, it is possible to reduce the volume of the first helical blade 44*a* and the second helical blade 44*c*, and to increase the space (for holding toner) in the pitch of the first helical blade 44*a* and the second helical blade 44*c*. When the second spiral 44 is formed by molding, expanding the parts corresponding to the seams in the mold makes it easy to separate the second spiral 44 from the mold.

The intersection 47 of the first helical blade 44*a* and the second helical blade 44*c* is arranged at the same position as the first expansion portions 48*a* and 48*d* of the first helical blade 44*a*, and thus it is possible to integrate together the first expansion portions 48*a* and 48*d* and the intersection 47 between the first helical blade 43*a* and the second helical blade 43*c*, of which both influence the flow of developer, and thereby to reduce the influence on developer. As a result, it is possible to suppress ruffling of developer and to suppress stress applied to developer, and thus it is possible to effectively overcome insufficient electrostatic charging of toner resulting from deterioration of carrier.

As shown in FIG. 5, the first expansion portion 48*b* of the first helical blade 44*a* where the first helical blade 44*a* does not cross the second helical blade 44*c* and the second expansion portion 49*a* of the second helical blade 44*c* where the second helical blade 44*c* does not cross the first helical blade 44*a* are located substantially on the same straight line in the axial direction of the rotary shaft 44*b*. The first expansion portion 48*c* arranged at a position where the phase is deviated 180° from the first expansion portion 48*b* and the second expansion portion 49*b* arranged at a position where the phase is deviated 180° from the second expansion portion 49*a* are located substantially on the same straight line in the axial direction of the rotary shaft 44*b*. Thus, as compared with a case where the first expansion portion 48*b*, the second expansion portion 49*a*, the first expansion portion 48*c*, and the second expansion portion 49*b* are all present at different positions in the axial direction of the rotary shaft 44, the flow of developer produced as the second spiral 44 rotates is stabilized, and thus the stirring of developer is also stabilized.

Figure 6:
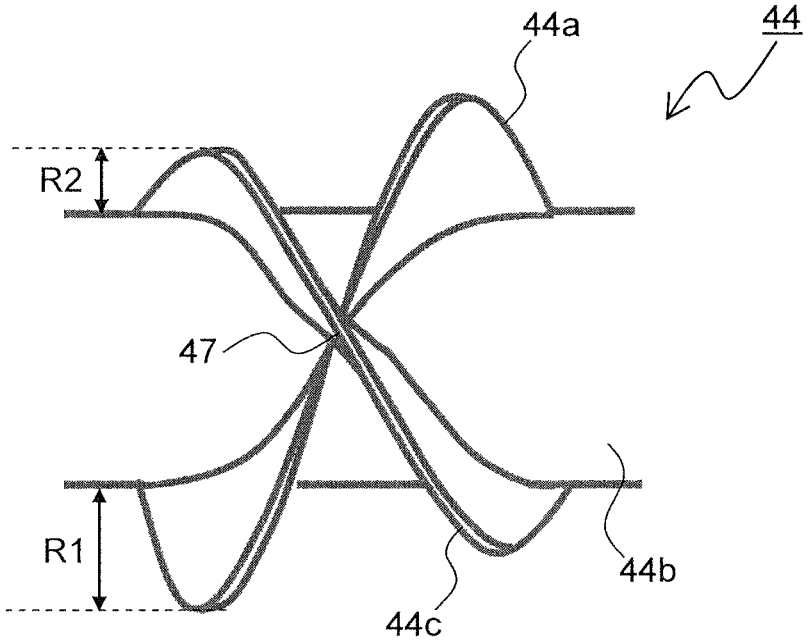
FIG. 6 is a partly enlarged view of a second spiral according to a second embodiment of the present disclosure as seen from the direction perpendicular to a rotary shaft.

FIG. 6 is a partly enlarged view of the second spiral 44 according to a second embodiment of the present disclosure as seen from the direction perpendicular to the rotary shaft 44*b*. In the embodiment, the radial height R1 of the first helical blade 44*a* is the smaller the closer to the intersection 47 such that, at the intersection 47, R1=0. Otherwise, the structure of the first spiral 44 is similar to that in the first embodiment.

With this configuration, the developer stagnating near the intersection 47 is more likely to disperse over the first helical blade 44*a*. The developer is more likely to enter, over the first helical blade 44*a*, a region near the intersection 47 where the density of developer is low. Thus, as in the first embodiment, it is possible to prevent developer from being uneven locally near the intersection 47, and thus to effectively overcome image unevenness resulting from non-uniform developer being fed to the developing roller 20. The second helical blade 44*c* is formed continuously without being interrupted at the intersection 47, and thus the conveying force in the opposite direction of the second helical blade 44*c* is prevented from reducing; this eliminates the danger of a reduced stirring effect on developer.

Figure 7:
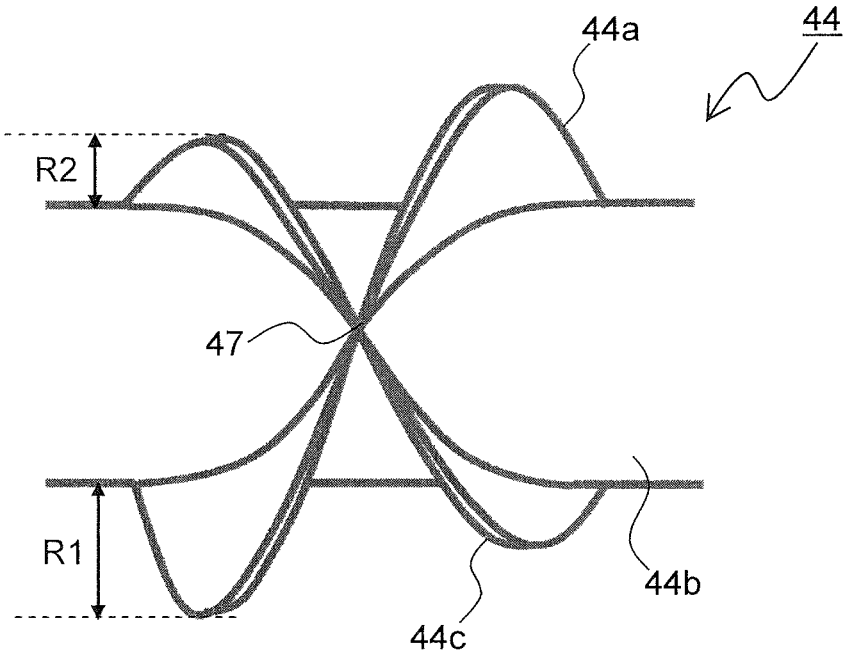
FIG. 7 is a partly enlarged view of a second spiral according to a third embodiment of the present disclosure as seen from the direction perpendicular to a rotary shaft.

FIG. 7 is a partly enlarged view of the second spiral 44 according to a third embodiment of the present disclosure as seen from the direction perpendicular to the rotary shaft 44*b*. In this embodiment, the radial height R1 of the first helical blade 44*a* and the radial height R2 of the second helical blade 44*c* are the smaller the closer to the intersection 47 such that, at the intersection 47, R1=0 and R2=0. Otherwise, the structure of the second spiral 44 is similar to that in the first embodiment.

With this configuration, as in the first and second embodiments, the developer stagnating near the intersection 47 is more likely to disperse over the first helical blade 44*a* and the second helical blade 44*c*. The developer is more likely to enter, over the first helical blade 44*a* and the second helical blade 44*c*, a region near the intersection 47 where the density of developer is low. Thus, it is possible to prevent developer from being uneven locally at the intersection 47, and thus to effectively overcome image unevenness resulting from non-uniform developer being fed to developing roller 20.

Figure 8:
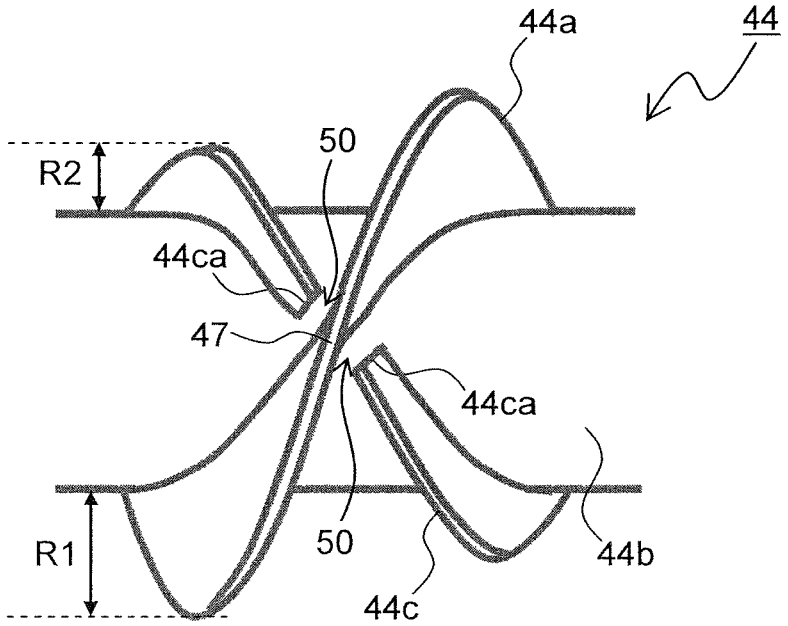
FIG. 8 is a partly enlarged view of a second spiral according to a fourth embodiment of the present disclosure as seen from the direction perpendicular to a rotary shaft.

FIG. 8 is a partly enlarged view of the second spiral 44 according to a fourth embodiment of the present disclosure as seen from the direction perpendicular to the rotary shaft 44*b*. In this embodiment, the radial height R2 of the second helical blade 44*c* is constant except at the intersection 47 such that, only near the intersection 47, R2=0. That is, edges 44*ca* of the second helical blade 44*c* are arranged opposite each other across gaps 50 on opposite side surfaces of the first helical blade 44*a* passing through the intersection 47. Otherwise, the structure of the second spiral 44 is similar to that in the first embodiment.

With this configuration, the developer stagnating near the intersection 47 is more likely to disperse through the gaps 50. The developer is more likely to enter, through the gaps 50, a region near the intersection 47 where the density of developer is low. Thus, it is possible to suppress stagnation of developer and lowering of developer density near the intersection 47, and thereby to prevent developer from being uneven locally near the intersection 47; it is thus possible to effectively overcome image unevenness resulting from non-uniform developer being fed to the developing roller 20. The first helical blade 44*a* is formed continuously without being interrupted at the intersection 47, and thus there is no danger of a reduced conveying force of the first helical blade 44*a*.

Figure 9:
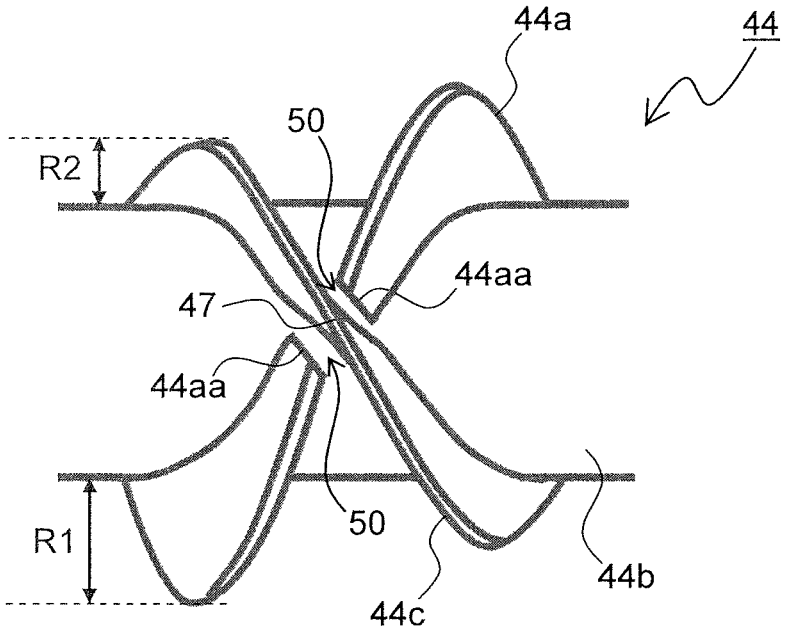
FIG. 9 is a partly enlarged view of a second spiral according to a fifth embodiment of the present disclosure as seen from the direction perpendicular to a rotary shaft.

FIG. 9 is a partly enlarged view of the second spiral 44 according to a fifth embodiment of the present disclosure as seen from the direction perpendicular to the rotary shaft 44*b*. In this embodiment, the radial height R1 of the first helical blade 44*a* is constant except at the intersection 47 such that, only near the intersection 47, R1=0. That is, edges 44*aa* of the first helical blade 44*a* are arranged opposite each other across gaps 50 on opposite side surfaces of the second helical blade 44*c* passing through the intersection 47. Otherwise, the structure of the second spiral 44 is similar to that in the first embodiment.

With this configuration, as in the fourth embodiment, the developer stagnating near the intersection 47 is more likely to disperse through the gaps 50. The developer is more likely to enter, through the gaps 50, a region near the intersection 47 where the density of developer is low. Thus, it is possible to prevent developer from being uneven locally near the intersection 47, and thus to effectively overcome image unevenness resulting from non-uniform developer being fed to the developing roller 20. The second helical blade 44*c* is formed continuously without being interrupted at the intersection 47, and thus the conveying force in the opposite direction of the second helical blade 44*c* is prevented from reducing; this eliminates the danger of a reduced stirring effect on developer.

Figure 10:
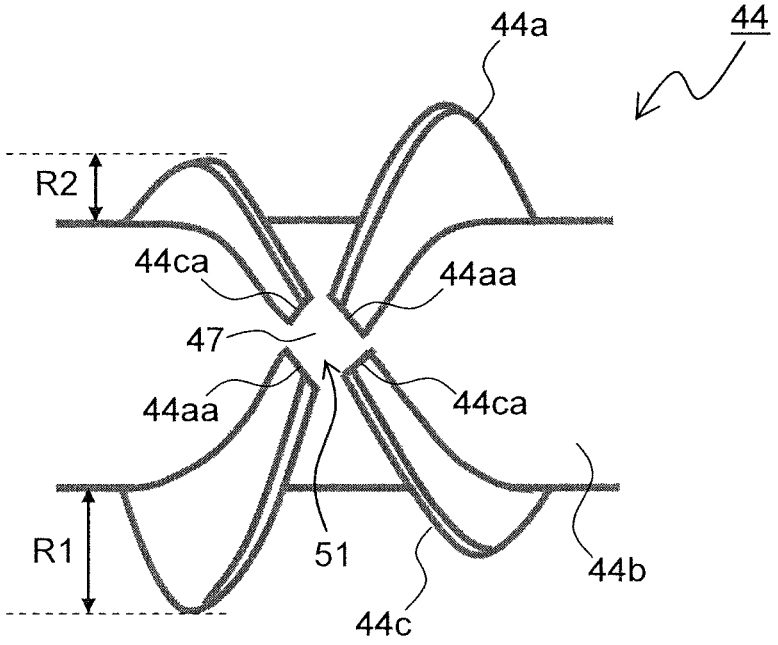
FIG. 10 is a partly enlarged view of a second spiral according to a sixth embodiment of the present disclosure as seen from the direction perpendicular to a rotary shaft.

FIG. 10 is a partly enlarged view of the second spiral 44 according to a sixth embodiment of the present disclosure as seen from the direction perpendicular to the rotary shaft 44*b*. In this embodiment, the radial height R1 of the first helical blade 44*a* and the radial height R2 of the second helical blade 44*c* are constant except at the intersection 47 such that, only near the intersection 47, R1=0 and R2=0. That is, across the intersection 47, edges 44*aa* of the first helical blade 44*a* and edges 44*ca* of the second helical blade 44*c* are both arranged opposite each other across a flat portion 51 in a rectangular shape. Otherwise, the structure of the second spiral 44 is similar to that in the first embodiment.

With this configuration, the developer stagnating near the intersection 47 is more likely to disperse through the flat portion 51. The developer is more likely to enter, through the flat portion 51, a region near the intersection 47 where the density of developer is low. Thus, it is possible to prevent developer from being uneven locally near the intersection 47, and thus to effectively overcome image unevenness resulting from non-uniform developer being fed to the developing roller 20.

In the third and sixth embodiments, at the intersection 47, the radial height R1 of the first helical blade 44*a* and the radial height R2 of the second helical blade 44*c* both equal zero, and this permits smoother flow of developer near the intersection 47 as compared in the first, second, fourth, and fifth embodiments. Thus, it is possible to suppress stagnation of developer and lowering of developer density more effectively. On the other hand, since the first helical blade 44*a* is not located at the intersection 47, the conveying force of developer is weaker than in the first and fourth embodiments. Since the second helical blade 44*c* is not located at the intersection 47, the stirring effect on developer is weaker than in the second and fifth embodiments.

Based on what is described above, it is preferable to select and use the configurations according to the first to sixth embodiments as necessary according to what is required in the developing device 2*a* in terms of the conveying force of developer, the stirring effect, and the suppression of stagnation of developer and lowering of developer density.

The embodiments described above are in no way meant to limit the present disclosure, which thus allows for many modifications and variations within the spirit of the present disclosure. For example, as shown in FIG. 3, although the above description deals with the developing device 2*a* in which the configurations of the first helical blade 44*a* and the second helical blade 44*c* as described in the above-described first to sixth embodiments are adopted in the first spiral 43 arranged in the first conveyance chamber 22*c* and the second spiral 44 arranged in the second conveyance chamber 22*d* in the developing device 2, depending on the specifications of developer, the stirring/conveying member according to the present disclosure may be used only in the first spiral 43 arranged in the first conveyance chamber 22*c* to increase the stirring effect only in the first conveyance chamber 22*c*. Or, the stirring/conveying member according to the present disclosure may be used only in the second spiral 44 arranged in the second conveyance chamber 22*d* to increase the stirring effect only in the second conveyance chamber 22*d*. The second spiral 44 has the function of feeding developer to the magnetic roller 21, and thus, to feed developer in a uniform state to the magnetic roller 21 to suppress image unevenness, the configuration according to the present disclosure is preferably applied at least to the second spiral 44.

Although FIG. 5 shows a configuration, as a modified example of the first embodiment, in which the first expansion portions 48*a* to 48*d* and the second expansion portions 49*a* and 49*b* are formed in the first helical blade 44*a* and the second helical blade 44*c* respectively, it is possible, also in the second to sixth embodiments, to form the first expansion portions 48*a* to 48*d* and the second expansion portions 49*a* and 49*b* in the first helical blade 44*a* and the second helical blade 44*c* respectively.

A stirring/conveying member according to the present disclosure is applicable, not only to a developing device 2, like the one shown in FIGS. 2 and 3, which has a developer supply port 22*g* and a developer discharge port 22*h* and which includes a magnetic roller 21 and a developing roller 20, but also to various developing devices that use two-component developer containing toner and carrier. Next, by way of practical examples, the effects of the present disclosure will be described more specifically.

Practical Examples

With an image forming apparatus 1 as shown in FIG. 1 incorporating the developing devices 2*a* to 2*d* shown in FIGS. 2 and 3, experiments were conducted to study the charging performance of carrier as the configurations of the first spiral 43 in the first conveyance chamber 22*c* and the second spiral 44 in the second conveyance chamber 22*d* were varied. The experiment was performed with respect to the image forming portion for magenta which included the photosensitive drum 11*a* and the developing device 2*a*.

In the experiment, the first spiral 43 and the second spiral 44 had rotary shafts 43*b* and 44*b* with a diameter of 6 mm, first helical blades 43*a* and 44*a* with a diameter of 17 mm (a radial height R1 of 5.5 mm) and a blade pitch of 30 mm, and second helical blades 43*c* and 44*c* with a diameter of 10 mm (a radial height R2 of 2.0 mm) and a blade pitch of 30 mm. The first spiral 43 and the second spiral 44 of the first embodiment where, as shown in FIG. 4, the radial height R2 of the second helical blade 43*c* and 44*c* was the smaller the closer to the intersection 47 such that, at the intersection 47, R2=0 were used in Practical Example 1.

The first spiral 43 and the second spiral 44 of the second embodiment where, as shown in FIG. 6, the radial height R1 of the first helical blades 43*a* and 44*a* was the smaller the closer to the intersection 47 such that, at the intersection 47, R1=0 were used in Practical Example 2. The first spiral 43 and the second spiral 44 of the third embodiment where, as shown in FIG. 7, the radial height R1 of the first helical blades 43*a* and 44*a* and the radial height R2 of the second helical blades 43*c* and 44*c* were the smaller the closer to the intersection 47 such that, at the intersection 47, R1=0 and R2=0 were used in Practical Example 3. The first spiral 43 and the second spiral 44 where neither the radial height R1 of the first helical blades 43*a* and 44*a* nor the radial height R2 of the second helical blades 43*c* and 44*c* was the smaller the closer to the intersection 47 were used in Comparative Example.

The developing devices 2*a* of Practical Examples 1 to 3 and Comparative Example were each charged with a predetermined amount of two-component developer containing positively charged toner having an average particle diameter of 6.8 μm and ferrite/resin-coated carrier having an average particle diameter of 35 μm. While the charging amount of developer was varied in steps, five halftone images each were printed with a printing ratio of 25%. By visually comparing image evenness among the printed images and a boundary sample, the printed images were evaluated to be either good when the image evenness was equal to or higher than that of the boundary sample or poor when the image evenness was lower than that of the boundary sample.

The images were formed under the following conditions. The developing roller 20 had a diameter of 20 mm, and was trail-rotated (in the reverse direction) at the plane facing the photosensitive drum 11*a* at a peripheral speed ratio of 1.8 to the photosensitive drum 11*a*. The gap between the photosensitive drum 11*a* and the developer roller 20 was 0.3 mm. The photosensitive drum 11*a* comprised an a-Si photosensitive member laid with an amorphous silicon photosensitive layer, and was subjected to a white background part potential (light potential) of +270 V and an exposed part potential (dark potential) of +20 V.

To the developing roller 20, a developing bias was applied having superimposed on a DC bias (Vdc) of 190 Van AC bias having rectangular waves with a peak-to-peak value of 1250 V, a frequency of 3.7 kHz, and a duty ratio of 50%. Table 1 shows the results.

TABLE 1

| DEVEL- | FIRST AND SECOND SPIRAL CONFIGURATION | | | |
|---|---|---|---|---|
| OPER AMOUNT [g] | PRACTICAL EXAMPLE 1 | PRACTICAL EXAMPLE 2 | PRACTICAL EXAMPLE 3 | COM-PARATIVE EXAMPLE |
| 160 | GOOD | GOOD | POOR | POOR |
| 180 | GOOD | GOOD | GOOD | POOR |
| 200 | GOOD | GOOD | GOOD | POOR |
| 220 | GOOD | GOOD | GOOD | POOR |

TABLE 1-continued

| DEVEL- | FIRST AND SECOND SPIRAL CONFIGURATION | | | |
|---|---|---|---|---|
| OPER AMOUNT [g] | PRACTICAL EXAMPLE 1 | PRACTICAL EXAMPLE 2 | PRACTICAL EXAMPLE 3 | COM-PARATIVE EXAMPLE |
| 240 | GOOD | GOOD | GOOD | GOOD |
| 260 | GOOD | GOOD | GOOD | GOOD |
| 280 | GOOD | GOOD | GOOD | GOOD |
| 300 | GOOD | GOOD | GOOD | GOOD |

Table 1 reveals the following. In Practical Example 1, where the radial height of the second helical blades 43*c* and 44*c* equaled zero at the intersection 47, and in Practical Example 2, where the radial height of the first helical blades 43*a* and 44*a* equaled zero at the intersection 47, the image evenness was good with any amount of developer from 160 g to 300 g. In Practical Example 3, where the radial heights of the first helical blades 43*a* and 44*a* and the second helical blades 43*c* and 44*c* both equaled zero at the intersection 47, the image evenness was good with an amount of developer from 180 g to 300 g but not with an amount of developer of 160 g.

In contrast, in Comparative Example, where the radial heights of the first helical blades 43*a* and 44*a* and the second helical blades 43*c* and 44*c* did not vary at the intersection 47 of the first helical blades 43*a* and 44*a* and the second helical blades 43*c* and 44*c*, the image evenness was good with an amount of developer from 240 g to 300 g but poor with an amount of developer from 160 g to 220 g. The image evenness was the better the larger the amount of developer in the developing device 2*a* because the ratio of conveyed toner to stagnant toner was then higher.

Based on the above results, it has been confirmed that, with the configurations of Practical Examples 1 to 3, the image evenness is good irrespective of the amount of developer as compared with the configuration of Comparative Example. The reason is considered to be as follows. In Practical Examples 1 to 3 where at least one of the radial height of the first helical blades 43*a* and 44*a* and the radial height of the second helical blade 43*c* and 44*c* equaled zero at the intersection 47, stagnation of developer and lowering of developer density near the intersection 47 were suppressed as compared with the configuration of Comparative Example where neither the radial height of the first helical blades 43*a* and 44*a* nor the second helical blades 43*c* and 44*c* equaled zero at the intersection 47. The reason that the image evenness was low with an amount of developer of 160 g in Practical Example 3 is considered that, with the configuration of Practical Example 3, the effect of conveying developer was weak with no helical blade located at the intersection 47 as compared with the configurations of Practical Examples 1 and 2.

Although no specific description will be given, it has been confirmed that a similar result can be obtained with the configurations of the first spiral 43 and the second spiral 44 used in the fourth to sixth embodiments shown in FIGS. 8 to 10.

The present disclosure finds application in developing devices incorporated in image forming apparatuses exploiting electrophotography, such as copiers, printers, facsimile machines, and multifunctional peripherals thereof, and in image forming apparatuses incorporating such developing devices. In particular, the present disclosure finds application as a stirring/conveying member in developing devices that use two-component developer containing toner and carrier.

What is claimed is:

1. A stirring/conveying member comprising:

a rotary shaft rotatably supported in a powder container;

a first helical blade formed on a circumferential surface of the rotary shaft, the first helical blade conveying powder in an axial direction by rotation of the rotary shaft; and a second helical blade formed on the circumferential surface of the rotary shaft to overlap a forming region of the first helical blade, the second helical blade spiraling in an opposite phase to the first helical blade, the second helical blade having a radial height smaller than a radial height of the first helical blade, wherein the first helical blade and the second helical blade have a trapezoidal sectional shape on a plane traversing the helical blades in a longitudinal direction thereof, the first helical blade crosses the second helical blade at least at one place in one turn about the rotary shaft, the first helical blade has a trapezoidal sectional shape on a plane traversing the longitudinal direction, a dimension of a base part of the trapezoidal sectional shape being uniform over an entire range in the longitudinal direction, the radial height of the second helical blade equals zero at all intersections of the first helical blade and the second helical blade, and the radial height of the first helical blade equals a predetermined height larger than zero at all the intersections.

2. The stirring/conveying member of claim 1, wherein the radial height of the second helical blade becomes smaller the closer to all intersections and equals zero at all intersections.

3. The stirring/conveying member of claim 1, wherein the first helical blade and the second helical blade cross each other at two places at an interval of 180° from each other in one turn about the rotary shaft.

4. The stirring/conveying member of claim 1, wherein let the radial height of the first helical blade be R1 and let the radial height of the second helical blade be R2, then $\frac{1}{4}\times R1 \leq R2 \leq \frac{1}{2}\times R1$ holds.

5. A developing device comprising:

a developer container which stores two-component developer containing carrier and toner;

a developer carrying member arranged in the developer container, the developer carrying member carrying developer in the developer container; and the stirring/conveying member of claim 1 which conveys, while stirring, developer in the developer container.

6. The developing device of claim 5, wherein the developer container has:

a plurality of conveyance chambers, including a first conveyance chamber and a second conveyance chamber, arranged side by side;

communication portions through which the conveyance chambers communicate with each other in opposite end parts of the first and second conveyance chambers in a longitudinal direction thereof; and a toner supply port through which toner is supplied into the first conveyance chamber, the developer carrying member is arranged to carry on a surface thereof developer in the second conveyance chamber, and the developing device further comprises:

a first stirring/conveying member which conveys, while stirring, developer in the first conveyance chamber in an axial direction of a rotary shaft; and a second stirring/conveying member which conveys, while stirring, developer in the second conveyance chamber in an opposite direction to the first stirring/conveying member, and the stirring/conveying member is used as the second stirring/conveying member.

7. The developing device of claim 6, wherein the stirring/conveying member is used as the first stirring/conveying member.

8. An image forming apparatus comprising the developing device of claim 5.

* * * * *